United States Patent [19]

Sulcer, Jr.

[11] Patent Number: 4,652,139

[45] Date of Patent: Mar. 24, 1987

[54] ELECTRONIC NON-VOLATILE ELAPSED TIME METER

[75] Inventor: James R. Sulcer, Jr., Athens, Ala.

[73] Assignee: Chrysler Motors Corporation, Highland Park, Mich.

[21] Appl. No.: 852,680

[22] Filed: Apr. 16, 1986

[51] Int. Cl.[4] ..... G04F 8/00

[52] U.S. Cl. ..... 368/9; 368/107; 368/113

[58] Field of Search ..... 368/9, 10, 107–113; 364/569

[56] References Cited

U.S. PATENT DOCUMENTS

| | | | |
|---|---|---|---|
| 3,351,910 | 11/1967 | Miller et al. | 368/107 |
| 3,689,839 | 9/1972 | Gother | 368/113 |
| 3,706,036 | 12/1972 | Marwell et al. | 368/107 |
| 4,376,995 | 3/1983 | Shimizu | 368/107 |
| 4,571,692 | 2/1986 | Germer | 364/483 |

*Primary Examiner*—Vit W. Miska

*Attorney, Agent, or Firm*—Wendell K. Fredericks

[57] ABSTRACT

An electronic non-volatile elapsed time meter useful for generating elapsed time information when connected in parallel with an input supply voltage supplying power to a power driven device. Visual readouts are continuously generated during time of use of the input supply voltage and accumulated intervals of time of use are stored in a non-volatile memory when power is removed from the device. Upon a later resumption of power usage, the stored non-volatile data is retrieved, displayed and summed with the new generated elapsed time information. This meter is applicable to both AC and DC operations.

14 Claims, 3 Drawing Figures

LCD Display
60
Display Driver
32
SK
DLEN
DATA
VDD
OSC
VSS
10
5V Source
Voltage Regulator
Reset Output
Delay
IN
26
34
38
54
56
58
5V
Current Limiter 14
Voltage Detector
24
40
42
46
48
50
52
16
18
20
22
44
11
13
12
Input
$V_{BAT}$
36
28
RES
MCU
VSS
IRQ
VCC
EXTAL
XTAL
MPS
Timer
PB7
PB6
PB5
PB4
PB3
PB0
PB1
PB2
30
VCC
ST
RE
VSS
CE
SK
DI
DO
NVM

ELECTRONIC NON-VOLATILE ELAPSED TIME METER

BACKGROUND OF THE INVENTION

1. Field of the Invention

This invention relates to indicating techniques which display elapsed time of power usage and more particularly in a preferred embodiment to apparatus for continuously generating displays indicative of elapses of time and for accumulating, storing and updating displays indicative of accumulated successions of intervals of elapsed time.

2. Description of the Prior Art

In prior art electronic elapsed time meters, it is well known to use digital indicators to display elapses of time between events initiated by manual start, stop and reset controls. But such elapsed time indicators do not contain means for storing data, recalling and updating data without maintaining continuous operating power.

Also in the prior art, there are demand registers for electric meters which determines intervals of demand for energy. Some of these demand registers include means for timekeeping, accumulating successive intervals of demand, storing, recalling and then updating such demand data. But, however, such devices are generally mechanically linked to the electric meters and are responsive to timing pulses emanating from the electric meter which are indicative of information which is related to time periods but primarily directed to energy demand.

BRIEF SUMMARY OF THE INVENTION

The present invention is concerned with an electronic elapsed time meter for determining accumulative elapsed time periods a supply voltage is applied to a device serviced by the supply voltage. A current limiting circuit is connected across the supply voltage to derive portion of a current of said supply voltage. The derived current is applied to a voltage regulator for generating a regulated voltage used within the meter and a delayed signal for initiating operation of a programmed microcomputer. The derived current is also applied to a voltage detector circuit used primarily to indicate to the microcomputer a cessation of the supply voltage. The microcomputer generates a sequence of control signals for accumulating and displaying time-of-use data and another sequence of control signals for storing the accumulated time of use data in a non-volatile memory. The accumulated data may be recalled from memory and additional times of use may be added to the recalled data and displayed on an LCD display.

DETAILED DESCRIPTION OF THE PREFERRED EMBODIMENT

Figure 1:
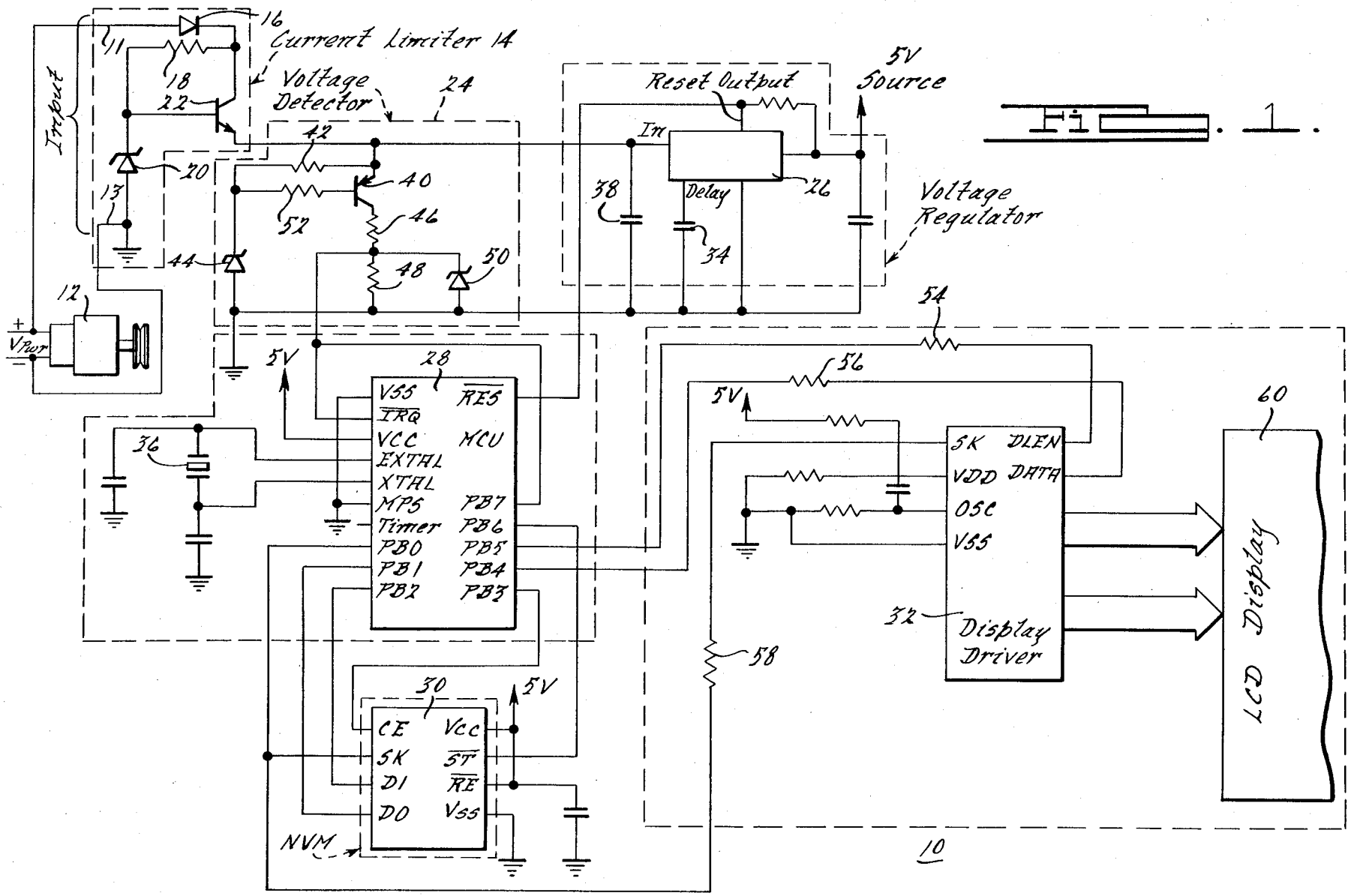
FIG. 1 is a partially block, partially schematic diagram of an electronic non-volatile elapsed time meter which sets the operating environment for the elapsed time meter according to the invention.

FIG. 1 is a schematic diagram of a preferred embodiment of an electronic non-volatile elapsed time meter 10. With positive (+) and negative (−) input terminals 11 and 13 respectively connected across a single-ended input of a powered device, illustratively a dc motor 12, the time of use of the supply voltage Vpwr can be derived. Generally, the negative input of supply voltage Vpwr is grounded or at a zero volt potential.

In order to dissipate some of the input current, a current limiting circuit 14 is used. Current from the positive input of motor 12 is applied via terminal 11 of meter 10 to diode 16. Diode 16, connected to be forward biased with respect to the input is used primarily to protect meter 10 from accidental and incidental polarity reversal of input voltages during meter hook-up operations. Current flowing from diode 16 diverts to a collector of npn transistor 22, e.g., a medium current, 40 W power transistor and to a cathode of zener diode 20 via resistor 18. With an anode of diode 20 grounded, current passage is prevented until breakdown voltage of diode (e.g. 18 VCD) is reached. Once breakdown voltage is reached, diode 20 maintains that voltage at a threshold over a varying range limiting base voltage of transistor 22 to a maximum of about 18 VDC. Transistor 22, being used primarily to dissipate input current which ordinarily flows through resistor 18 to the anode of diode 20, goes into saturation when it's base voltage reaches, e.g., 4 volts, providing emitter current to both a voltage detector circuit 24, used primarily to detect cessations of input current, and a voltage regulator circuit 26 used to establish a precised output voltage (e.g. 5 VDC±2.5%).

Emitter current of transistor 22 is applied to an input of voltage regulator 26 which is a very low dropout 5 V voltage regulator such as a SGS model L487. Such a regulator can work correctly providing a precise output voltage of 5 VDC±2.5% when the input voltage falls as low as 6 volts. When operating, regulator 26 provides 5 VDC system power to a microcomputer (MCU) 28, a non-voltatile memory (NVM) 30, and a liquid crystal display (LCD) driver 32. Regulator 26 also provides, after an externally programmed delay, a RESET signal to reset MCU 28 during a power-on phase. The RESET signal which is applied to RES terminal of MCU 28 is a delayed signal allowing NVM 30 and LCD driver 32 to become fully operable prior to being subjected to microcomputer MCU control. Capacitor 32 provides the external programmed delay function, holding the output voltage of regulator 26 "LO" for a fraction of time (e.g. 10 ms) delaying start-up of MCU 28. After the delay, $\overline{\text{RES}}$ goes HI, and MCU 28 starts executing a factory installed program (the main software program) stored in ROM of MCU 28. Capacitor 32, connected to the input of regulator 26 is used to delay removal of power to regulator 26 for approximately 100 ms when Vpwr to meter 10 goes away.

MCU 28, illustratively is a single chip 8-bit unit such as a Motorola ML6804J2 microcomputer chip containing a CPU, on-chip clock, ROM, RAM, I/O and a timer. The on-chip clock is controlled by an external oscillator 36. Port B provides input/output lines PB0 through PB7. It should be appreciated that other conventional microcomputers which are not packaged on a single integrated chip may also be employed in accordance with the present invention.

As mentioned previously, emitter current of transistor 22 is applied to voltage detector circuit 24. This emitter current is applied to both an emitter of PNP transistor 40, which may be a small signal, 325 milliwatt transistor, and via resistor 42 to a cathode of zener diode 44 having illustratively, a 6.2 VDC threshold. Diode 44 prevents base voltage applied via resistor 52 to transistor 40 from exceeding 6.2 VDC. Transistor 40 goes into saturation when turned ON causing collector current to be applied to a voltage limiting circuit formed by resistor 46, resistor 48 and, illustratively, a 5.1 V zener diode 50. The limited voltage is applied to $\overline{IRQ}$ and PB7 terminals of MCU 28. $\overline{IRQ}$ stays HI until transistor 40 cuts off i.e. when the input voltage drops to around 8 VDC. When $\overline{IRQ}$ goes LO, MCU 28 interrupts the main program and then performs the interrupt routine used primarily to store final data in NVM 30.

NVM 30, illustratively, a 256-bit serial access Xicor NOVRAM memory is organized as 16 words of 16 bits each. Each bit of static RAM is overlapped with a bit of non-volatile electrically erasable PROM ($E^2$PROM). Data can be transferred back and forth between the two memories either by instructions sent from MCU 28 over a serial bus or by toggling external STORE and RECALL input pins, respectively, of NVM 30. Non-volatile data is retained in the $E^2$PROM while independent data can be accessed and updated in the RAM.

To transfer data from MCU 28 to NVM 30, an enable (CE) signal must be initiated by MCU 28 via PB3 to chip enable terminal (CE) of NVM30. Since data is transferred serially, initial and each succeeding data is placed on PB2 and then clocked over to NVM 30 data port "D1". Data transferred from NVM 30 to MCU 28 is sent between port "D0" of NVM to PB1 of MCU 28.

During execution of the main program, LCD display driver 32 is updated every 36 seconds but the LCD display 60 is only updated every 360 seconds. LCD driver 32 is used to driver display 60 in response to signals from MCU 28. LCD driver 32, illustratively, is a PCE 2100 single chip silicon gate C-MOS circuit made by signetics. Data is transferred serially between MCU 28 and LCD driver 32. A data line enable signal is sent from PB5 of MCU 28 via resistor 54 to a "DLEN" port on LCD driver 32. Data is sequentially transferred from PB4 of MCU 28 via resistor 56 to a "DATA" port on LCD driver 32 in response to clock pulses from PB0 of MCU 28 via resistor 58 to a "SK" port on LCD driver 32. LED or other suitable optical elements may be used for providing visual readouts.

The operation of elapsed time meter 10 will now be discussed. Assuming, the time of use of motor 12 of FIG. 1 is desired. Meter 10 is connected as shown. Assume motor 12 requires 30 VDC, supply voltage Vpwr. Because meter 10 is connected parallel with the supply voltage, Vpwr is applied to the current limiting circuit 14 which in turn applies emitter current to voltage detector circuit 24 and voltage regulator circuit 26. The 5 V source voltage from regulator 26 is applied to MCU 28, NVM 30 and LCD driver 32 but $\overline{RES}$ terminal at MCU is held LO for approximately 30 MS to allow NVM 30 and LCD driver 32 to become fully operable. After the 30 ms, MCU 28 initiates a sequence of instructions of the program that is stored in ROM.

Figure 3:
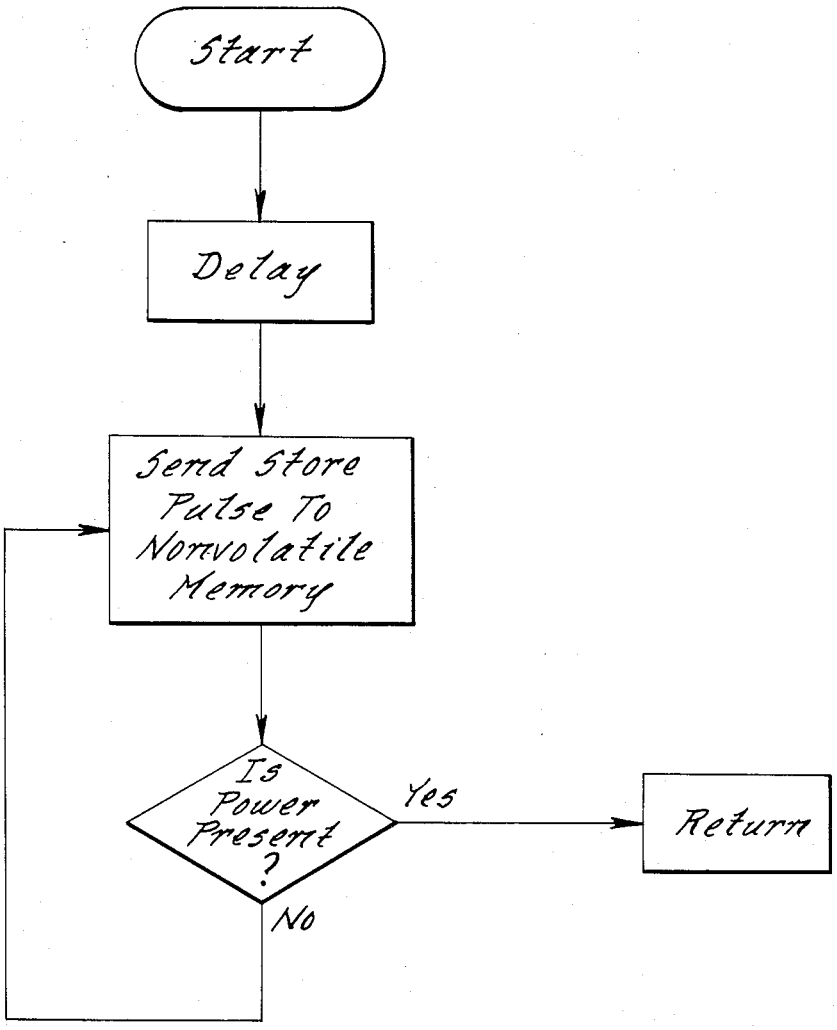
FIG. 3 is another flow chart showing an interrupt routine used by the microcomputer of this invention, the interrupt routine being initiated by a signal external to the microcomputer.

With reference now to FIG. 3, the sequence of instructions of a main program executed by MCU 28 is shown. MCU 28 causes previously accumulated and stored time-of-use data to be recalled from NVM 30 and read into the central processor of MCU 28. This recalled data is the starting or reference point from which time-of-use is measured. If no previous data had been accumulated in NVM 30, data respresenting zero time (e.g. 0000.00) is shifted from the E2PROM (non-volatile data storage portion of NVM 30) to the static RAM (volatile data storage portion of NVM 30). If previous time data has been stored in $E^2$PROM, then that data is transferred to RAM. It it is desired to erase the previously stored non-volatile data, a manually operated single pole, single throw switching device, associated with accompanying firmware, not shown in FIG. 1, which is normally closed to ground, could be used to apply 5 VDC to an auxiliary port (e.g. Port PA 4 of the Motorola chip) of MCU 28 to generate an erase signal, which is then sent to NVM 30 to erase the non-volatile contents in memory. It may be noted that the non-volatile data in $E^2$PROM may be retained for very long periods of time e.g. several years without power being applied to NVM 30.

Figure 2:
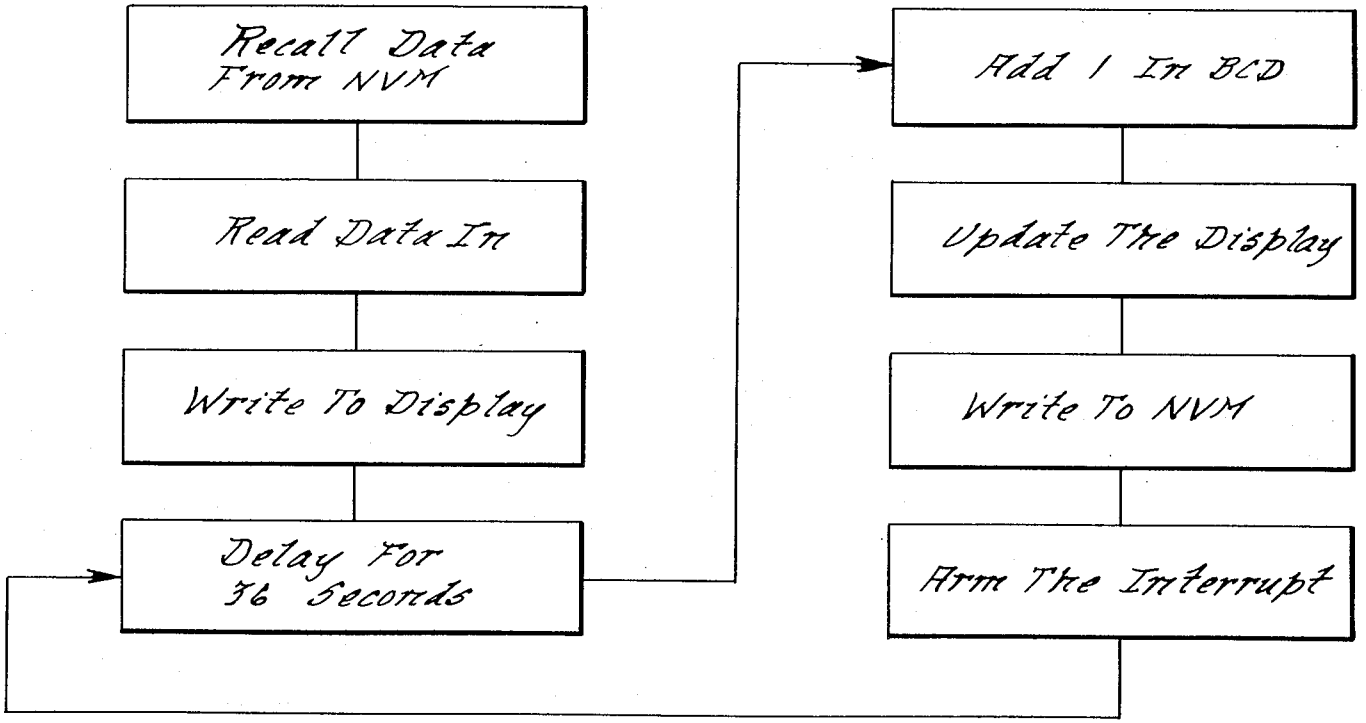
FIG. 2 is a flow chart indicative of routine used by the microcomputer of this invention to accumulate elapsed time data.

Then as indicated in FIG. 2, MCU 28 causes the previously stored time data to be read into its central processor for updating purposes. The data is, however, sent to the display driver 32 wherein it is displayed as an initial time value.

Then MCU 28 executes the loop which causes the previous time data to be updated every 1/100 of an hour or every 36 seconds by adding a "1" in BCD to the data. The data in the display driver 30 is updated each time the loop is executed, but the display 60 is not changed until 10 passes through the loop are executed, i.e. every 1/10 of an hour. Each time the previous time data is updated, the new time value is sent to the static RAM portion of NVM 30 as volatile data. Following each "WRITE TO NVM" is executed, the interrupt logic in MCU 28 is armed presenting an opportunity for an externally initiated interrupt to occur.

When the voltage drops to around 8 volts, the voltage detector circuit 24 senses it. Transistor 40 of circuit 24 cuts-off and $\overline{IRQ}$ of MCU goes LO which starts an interrupt routine as shown in FIG. 3. Capacitor 38 associated with voltage regulator 26 holds the input voltage to voltage regulator 26 for at least 100 ms providing time for the interrupt routine to be executed. After a fraction of a second delay, the interrupt routine initiates a store pulse singal to NVM 30 which in turn transfers the count from RAM to the $E^2$PROM so as to store the last count as non-volatile data. If after storing the count, power is still present the MCU 28 returns to the main programs and continue accumulating counts until Vpwr goes away, the interrupt routine is completed and no further supply voltage is present to measure with the present hook-up.

This meter 10 may also be used to count time of use of AC powered devices provided an AC to DC converter is connected between the device and the input to meter 10 and proper switches are included permitting switching in or out the converter circuit for when AC power is being used or for when the converter is being bypassed.

What is claimed is:

1. An electronic non-volatile elapsed time meter for determining successive time period lapsing between application and removal of supply voltage from a single-ended input of a power driven device comprising:

(a) current limiting means connected across said single-ended input of said device for regulating a portion of an input current associated with said input voltage to a predetermined level;

(b) voltage regulator means connected to said current limiting means to receive another portion of said input current so as to generate a precised regulated output voltage for use within said meter, said voltage regulator means including means for initiating a delayed reset signal indicative of presence of the supply voltage;

(c) a voltage detector means connected between said current limiting means and said voltage regulator means for generating a signal indicative of a cessation of said input voltage;

(d) display means for displaying an account of time of use of the supply voltage applied to said device;

(e) memory means for storing independent and non-volatile data indicative of an accumulation of said account of time-of-use of said supply voltage;

(f) microcomputer means, interconnecting said voltage detector means, said voltage regulator means, said memory means and said display means for determining independent time of use count data relative to periods of application and then removal of the supply voltage to said device, for transferring independent count data of the time of use of said supply voltage to said display driver means and said memory means so as to constantly update said independent count data while said supply voltage is being applied to said device and to initiate conversion of said independent count data to non-volatile data in response to said signal from said voltage detector means indicative of a cessation of said supply voltage.

2. Apparatus in accordance with claim 1 including serial transmission means for communicating between said microcomputer means and said memory means as well as between said microcomputer means and said display means.

3. Apparatus in accordance with claim 1 wherein said memory means is a non-volatile memory means including a static RAM memory and an electrically erasable PROM, when each bit of said RAM memory is overlayed by a bit of said electrically erasable PROM.

4. Apparatus in accordance with claim 1 wherein said voltage regulator means provides a precise regulated voltage for said microcomputer means, said memory means and said display means.

5. Apparatus in accordance with claim 4 wherein said voltage regulator means also providing a delayed reset signal indicative of presence of said supply voltage to said microcomputer means, wherein said delayed reset signal being used to inhibit operation of said microcomputer means for a chosen delay period so that the precised regulated voltage may be applied to said memory means and said display means permitting said memory means and said display means to be fully operable prior to the time when said microcomputer means becomes operable.

6. Apparatus in accordance with claim 5 wherein said microcomputer means is programmed to generate a sequence of control signals after removal of said delayed reset signal from said voltage regulator means for recalling non-volatile data from said memory means and then adding successive presently occurring accounts of time during which the supply voltage is being applied to the device.

7. Apparatus in accordance with claim 6 wherein said signal from said voltage detector indicative of the cessation of the supply voltage is applied to said microcomputer means, wherein said signal indicative of the cessation of the supply voltage is used for directing said for transferring to said memory means an accumulated count of said recalled non-volatile data and said added successive presently occurring account of time when the supply voltage being applied to said device is terminated.

8. Apparatus in accordance with claim 1 wherein said display means include an optical display means, wherein said optical display means is an LCD display.

9. An apparatus in accordance with claim 1 including means for converting an AC supply voltage into a DC voltage permitting said meter to be used to determine and accumulate time-of-use of AC supply voltage being applied to a device being serviced by an AC supply voltage.

10. An electronic non-volatile elapsed time meter for determining, accounting and accumulating time of use of a supply voltage being used to power a device, wherein said device may be either an AC or a DC device said system comprising:

(a) an AC to DC converter connected to an AC supply voltage for converting the AC supply voltage to a DC supply voltage;

(b) current limiting means connected to the AC supply voltage for deriving a portion of a current of a voltage of the DC supply voltage;

(c) switching means for unconnecting said AC converter from said current limiting means when a DC supply voltage is being used to power a device and for connecting the DC supply voltage to said current limiting means;

(d) voltage regulator means connected to said current limiting means for using said portion of current of said supply voltage to develop a precised regulated voltage for use within said meter, said regulator means also providing a delayed reset signal for use within said meter;

(e) voltage detection means connected to said current limiting means for using said portion of current of said supply voltage to develop a signal for use within said meter indicative of a cessation of said supply voltage;

(f) memory means for storing independent and non-volatile data related to accounting the accumulating time of use of the supply voltage which powers the device;

(g) display means for displaying values indicative of time of use of the supply voltage, said display means including display driver means and a display device, said display device being driven and controlled by said display driver means; and (h) microcomputer means interconnecting said voltage regulator means, said voltage detection means, said memory means and said display means for generating sequences of control signals used for determining, accounting and accumulating time of use of the supply voltage.

11. Apparatus in accordance with claim 10 wherein said precised regulated voltage for use witin said meter is used to power said memory means, said microcomputer means and said display means.

12. Apparatus in accordance with claim 10 wherein said delay reset signal is applied to said microcomputer means so as to delay turning on the microcomputer a chosen period of time in order to allow said memory means and display means to be fully operable before the microcomputer becomes operable.

13. Apparatus in accordance with claim 12 wherein upon expiration of said reset delay signal, said microcomputer means generates the series of control signals for determining a series of numerical values indicative of time of use of the supply voltage, for accounting for said series of numerical values, and for accumulating said series of numerical values, wherein said signal indicative of the cessation of said supply voltage is applied to said microcomputer means for generating a series of control signals which terminates the accumulation of said numerical values and transfers the accumulated values to said memory means forming non-volatile data representing the accumulated numerical values of the time the powered device used the supply voltage.

14. Apparatus in accordance with claims 1 or 10 including means for erasing said non-volatile data stored in said memory means by user initiation.

* * * * *